US007222399B2

(12) United States Patent
Eisenbraun

(10) Patent No.: US 7,222,399 B2
(45) Date of Patent: May 29, 2007

(54) MERCHANDISING HANGER

(76) Inventor: Kenneth D. Eisenbraun, 659 Overhill Rd., Bloomfield Village, MI (US) 48301

( * ) Notice: Subject to any disclaimer, the term of this patent is extended or adjusted under 35 U.S.C. 154(b) by 0 days.

(21) Appl. No.: 10/824,110

(22) Filed: Apr. 14, 2004

(65) Prior Publication Data

US 2004/0217249 A1 Nov. 4, 2004

Related U.S. Application Data

(60) Provisional application No. 60/463,664, filed on Apr. 17, 2003.

(51) Int. Cl.
*A41F 1/08* (2006.01)
*A44B 1/04* (2006.01)
*A44B 11/25* (2006.01)
*A44B 17/00* (2006.01)

(52) U.S. Cl. ..... 24/474; 24/469; 24/470; 24/472; 24/473; 40/642.01; 40/662; 40/665

(58) Field of Classification Search ..... 24/469, 24/470, 472, 473, 474, 475, 476, 595.1; 40/662, 40/663, 666, 667, 668, 669, 672, 673, 665, 40/642.01; 248/74.3, 74.5, 230.8
See application file for complete search history.

(56) References Cited

U.S. PATENT DOCUMENTS 2,554,105 A * 5/1951 Heinle ..... 40/662
3,126,185 A * 3/1964 Christman ..... 248/74.3
3,169,004 A * 2/1965 Rapata ..... 248/71
3,516,124 A * 6/1970 Merser ..... 24/16 PB
3,708,835 A * 1/1973 Bienz ..... 24/16 PB
3,758,060 A * 9/1973 Schuplin ..... 248/74.3
4,149,329 A * 4/1979 Graves ..... 40/668
4,198,772 A * 4/1980 Furutu ..... 40/665
4,664,432 A * 5/1987 Swift ..... 292/282
4,811,977 A * 3/1989 Swift et al. ..... 292/307 A
5,367,809 A * 11/1994 Ross ..... 40/668
6,401,304 B1 * 6/2002 Dossett ..... 24/16 PB
6,581,885 B2 * 6/2003 Polad ..... 248/74.3

* cited by examiner

*Primary Examiner*—Amy J. Sterling
(74) *Attorney, Agent, or Firm*—Gifford, Krass, Sprinkle, Anderson & Citkowski, P.C.

(57) ABSTRACT

A merchandising hanger has a planar surface adapted to receive printed indicia thereon and characterized by having a top and a base. The top of the planar surface is formed as a hook, cutout, or hole so as to allow the merchandising hanger to be suspended from a conventional merchandising rack. A tab extends from the base of the planar surface and includes a stud integral with the tab and a stud-receiving aperture in another portion of the tab. The aperture has a flange associated therewith. Intermediate between the stud and the aperture is a tab portion having a thickness less than the tab portion proximal to the planar surface. The relative thicknesses of tab portions and the interaction between the stud and complementary aperture afford a theft deterrent without compromising the merchandising function.

18 Claims, 2 Drawing Sheets

MERCHANDISING HANGER

RELATED APPLICATION

This application claims priority of U.S. Provisional Patent Application Ser. No. 60/463,664 filed Apr. 17, 2003, which is incorporated herein by reference.

FIELD OF THE INVENTION

The present invention generally relates to merchandising hangers, and in particular to merchandising hangers for portable electronic accessories.

BACKGROUND OF THE INVENTION

A merchandise hanger allows a retailer to efficiently display a suspended article while affording a customer an opportunity to handle the merchandise. The opportunity for a customer to come into physical contact with the merchandised article is especially beneficial in the context of portable electronic device accessories that must be compatible with a given device. Typically, a hanger is molded from synthetic plastic materials configured as a shallow profiled strip. Such plastic strips often integrate intermediate between the hanger portion and the merchandise engaging portion an identification display mounting card. While merchandising hangers are well suited to provide consumer interactivity, such hangers are particularly susceptible to theft and damage owing to the ease in which a stud is released from a securing aperture that together form the suspension loop for the merchandised article. Thus, there exists a need for a merchandising hanger that is resistant to tampering.

SUMMARY OF THE INVENTION

A merchandising hanger is described that has a planar surface adapted to receive printed indicia thereon and characterized by having a top and a base. The top of the planar surface is formed as a hook, cutout, or hole so as to allow the merchandising hanger to be suspended from a conventional merchandising rack. A tab extends from the base of the planar surface and includes a stud integral with the tab and a stud-receiving aperture in another portion of the tab. The aperture has a flange associated therewith. Intermediate between the stud and the aperture is a tab portion having a thickness less than the tab portion proximal to the planar surface. The relative thicknesses of tab portions and the interaction between the stud and complementary aperture afford a theft deterrent without compromising the merchandising function.

DESCRIPTION OF THE INVENTION

Figure 1:
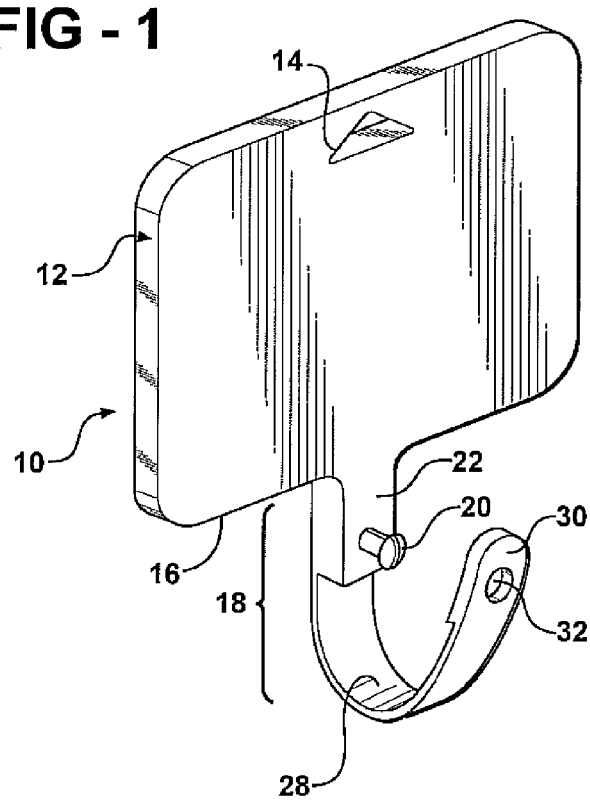
FIG. 1 is a perspective view of an inventive merchandising hanger.
Figure 2:
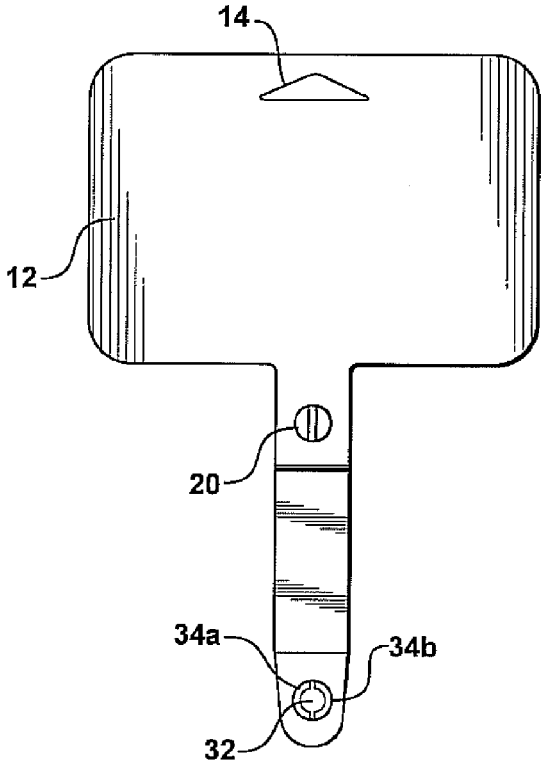
FIG. 2 is a right side planar view of a hanger depicted in FIG. 1.
Figure 4:
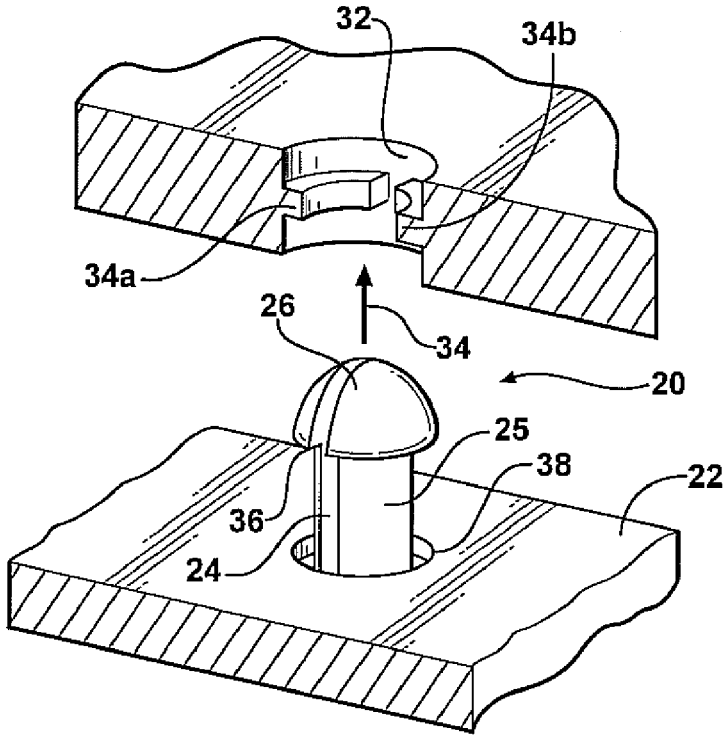
FIG. 4 is an enlarged cross-sectional view showing the stud and securing aperture portions of an inventive hanger as depicted in FIG. 1.

Referring to FIG. 1, an inventive hanger is shown generally at 10 formed of a one-piece body of plastic material having a planar surface 12 adapted to receive printed indicia thereon. The flat planar surface 12 has a top forming a hook or cutout 14 configured to receive a conventional merchandising rod therethrough. The planar surface 12 has a basal surface 16 with a tab 18 extending therefrom. The tab 18 has a stud 20 projecting from a first tab portion 22. The stud 20 preferably has a cubo-hedral body 24 terminating in a conical head 26. Preferably, the conical head 26 is hemispherical. A second tab portion 28 has a thickness less than the first tab portion 22 and interconnects the first tab portion with a third tab portion 30. The third tab portion 30 has an aperture 32, the aperture 32 adapted to pressure fit over the conical head 26 and thereby secure the third portion 30 against the first portion 22 and in the process forming a loop in which an article is connected. More preferably, the aperture 32 contains a deformable flange 34 shown in an enlarged view of FIG. 4. More preferably, the deformable flange 34 forms a pair of opposing portions 34*a* and 34*b* that are generally parallel with the elongate side 25 of stud body 24. The flange 34 is intended to deform away from the conical head 26 upon the third tab portion being pressed against the stud 20. Upon the head 26 being pressed beyond flange 34, the flange 34 remains deformed as the body 24 of the stud 20 encompasses the aperture 32. The flange 34 abuts the rearward face 36 of the head 26 in order to inhibit disengagement between the aperture 32 and the stud 20. Optionally, the head 26 is heat stamped or pressure flattened after engaging the aperture 32 to preclude casual disengagement (not shown).

According to the present invention, the thickness of the tab portions has a ratio between first portion:second portion: third portion of 1.5–3.5:1:1.3–2.5. More preferably, the ratio of first portion:second portion:third portion of the tab 18 is between 2.0–3.0:1:1.3–2.0. The relative thickness of the planar surface 12 relative to the first portion 22 is between 0.5–2.0:1.0. Preferably, the planar surface 12 and the first portion 22 are of a thickness that varies between the two by less than 20%. More preferably, the thickness of the first portion 22 is between 1.5 and 3.0 millimeters in thickness. It is appreciated that strength characteristics of the injection moldable plastic from which an inventive hanger 10 is made dictate the optimal thickness of the hanger portions. Suitable thermoplastic materials from which an inventive hanger is formed illustratively include materials like or similar to polyethylene, polypropylene, polycarbonate and acrylonitrile butadiene styrene.

Optionally, in the region where the body 24 of the stud 20 extends from the first tab portion 22, at least one opening 38 is provided in the first tab portion 22 adjacent to the base 24 of the stud 20. Preferably, there are two openings 38 on either side of base sides 25. The openings 38 are preferably present in the instances where the thermoplastic melt has a viscosity that requires additional pressure to urge material into the form of the stud 20.

Figure 3:
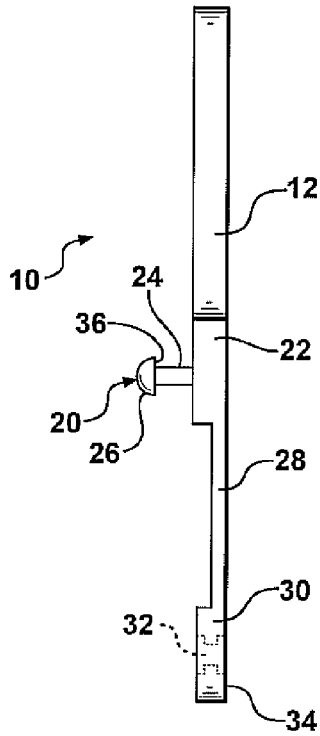
FIG. 3 is a rear view of the hanger depicted in FIG. 1.

It is appreciated that the relative location of the stud and securing aperture are readily reversed consistent with the present invention as shown in FIG. 3 where an alternate embodiment of a hanger is shown generally at 50. With respect to FIG. 3, like numerals denote portions as described previously with respect to the embodiment depicted in FIGS. 1–4.

Figure 5:
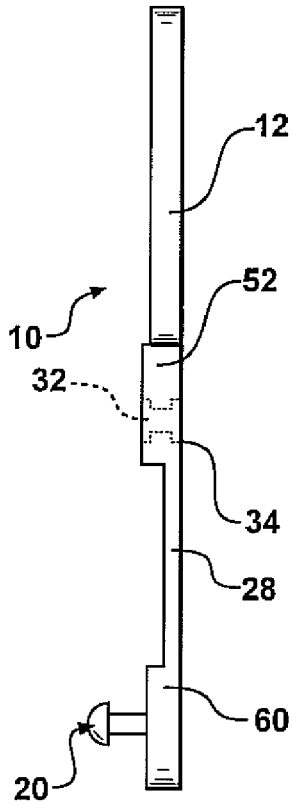
FIG. 5 is a right side planar view of an alternate embodiment of an inventive hanger.

Referring now to FIG. 5, a securing aperture 32 having a flange 34 internal thereto. The aperture 32 residing in a first tab portion 52 that extends from a planar surface 12. A second tab portion 28 is intermediate between the first tab portion 52 and a third tab portion 60. The third tab portion 60 having a stud 20 extending therefrom. The cross-sectional thickness ratio of the first portion:second portion:third portion of the hanger 50 and the relative portion thicknesses are those detailed with respect to the inventive embodiment detailed with respect to FIGS. 1–4.

Although the present invention has been described relative to preferred embodiments thereof, one skilled in the art will readily appreciate that other variations and modifications will be apparent that nonetheless remain within the spirit of the invention. It is intended that the present invention not be limited by the specific disclosure herein but only by the appended claims.

The invention claimed is:

1. A hanger for suspending an article of merchandise from a rod, comprising:

a planar surface having a top at one end and a base at the opposed end, the planar surface adapted to receive printed indicia thereon and having a first opening adjacent the top for suspending the hanger from a rod; and a tab extending from the base of said surface, said tab having a stud with a base integral with one of a first tab portion or a third tab portion and an enlarged cap on its opposite end, and an aperture having a flange therein through the first tab portion or the third tab portion not having the stud integral therewith, the first tab portion having a first tab portion thickness, the third tab portion having a third tab portion thickness, and intermediate between the first tab portion and the third tab portion a second tab portion having a second tab portion thickness where the second tab portion thickness is less than the first tab portion thickness;

whereby said enlarged cap of the stud may be inserted through said aperture so as to be engaged by said flange to form a loop in the second tab portion for retaining the article of merchandise suspended from the rod.

2. The hanger of claim 1 wherein the stud has a body and the cap of the stud is conical.

3. The hanger of claim 1 wherein there is a second opening adjacent to the base of the stud in the first tab portion or in the third tab portion integral therewith.

4. The merchandising hanger of claim 1 wherein the stud extends from the first tab portion and the aperture is through the third tab portion.

5. The hanger of claim 1 wherein the flange is divided into a plurality of flange portions.

6. The hanger of claim 1 wherein said planar surface and said tab are a single piece molded of a thermoplastic material.

7. The hanger of claim 2 wherein the conical cap is hemispherical.

8. The hanger of claim 1 wherein the ratio of the first tab portion thickness:second tab portion thickness:third tab portion thickness is 1.5–3.5:1:1.3–2.5.

9. The hanger of claim 8 wherein the first tab portion thickness is greater than the third tab portion thickness.

10. A hanger for suspending an article of merchandise from a rod, comprising:

a planar surface having a top at one end and a base at the opposed end, the planar surface adapted to receive printed indicia thereon and having a first opening adjacent the top for suspending the hanger from a rod; and a tab extending from the base of said surface, said tab having a stud with an enlarged end and a base integral with one of a first tab portion or a third tab portion and an aperture through the first tab portion or the third tab portion not having the stud integral therewith, the first tab portion having a first tab portion thickness, the third tab portion having a third tab portion thickness and intermediate between the first tab portion and the third tab portion a second tab portion having a second tab portion thickness wherein the ratio of the first tab portion thickness:second tab portion thickness:third tab portion thickness is 1.5–3.5:1:1.3–2.5;

whereby said enlarged end of the stud may be inserted through said aperture to form a loop in the second tab portion for retaining the article of merchandise suspended from the rod.

11. The hanger of claim 10 wherein the stud has a body and the enlarged end is formed with a conical cap.

12. The hanger of claim 10 wherein the aperture has a flange therein formed intermediate its thickness and extending into the aperture.

13. The hanger of claim 10 wherein there is a second opening adjacent to the base of the stud in the first tab portion or in the third tab portion integral therewith.

14. The merchandising hanger of claim 10 wherein the stud extends from the first tab portion and the aperture is through the third tab portion.

15. The hanger of claim 12 wherein the flange is divided into a plurality of flange portions.

16. The hanger of claim 12 wherein said planar surface and said tab are a single piece molded of a thermoplastic material.

17. The hanger of claim 11 wherein the conical cap is hemispherical.

18. The hanger of claim 10 wherein the first tab portion thickness is greater than the third tab portion thickness.

* * * * *